United States Patent [19]

Brefka

[11] 4,407,265

[45] Oct. 4, 1983

[54] WOOD STOVE AIR FLOW REGULATING

[75] Inventor: Paul E. Brefka, Southborough, Mass.

[73] Assignee: Energy Harvesters Corporation, Fitzwilliam, N.H.

[21] Appl. No.: 968,288

[22] Filed: Dec. 11, 1978

[51] Int. Cl.[3] ..... F23M 7/00

[52] U.S. Cl. ..... 126/193; 126/290

[58] Field of Search ..... 126/193, 80, 290, 198, 126/190, 192, 112, 163

[56] References Cited

U.S. PATENT DOCUMENTS

| | | | |
|---|---|---|---|
| 928,737 | 7/1909 | Cahoone | 126/193 |
| 2,350,830 | 6/1944 | Schen | 126/290 |
| 2,443,525 | 6/1949 | Weyenberg | 126/290 |

*Primary Examiner*—Samuel Scott
*Assistant Examiner*—George Anderson
*Attorney, Agent, or Firm*—Charles Hieken

[57] ABSTRACT

A wood stove has primary and secondary air regulator doors at the bottom and top, respectively, of the stove door each rotating about the axis of a tightening knob in the center of the door opposite a baffle plate that defines with the door inside an air channel open at the top and bottom.

7 Claims, 4 Drawing Figures

WOOD STOVE AIR FLOW REGULATING

BACKGROUND OF THE INVENTION

The present invention relates in general to wood stove air flow regulating and more particularly concerns novel apparatus and techniques for independently adjusting primary and secondary air flow in a wood stove in convenient structural form that locks both primary and secondary regulators in selected positions with but a single locking control in the wood stove door while providing an internal air flow channel with structure that helps prevent sparks from escaping through the air inlets.

The high cost of nonrenewable fossil fuels has stimulated a demand for wood stoves. One typical prior art wood stove includes a single air regulator that is movable to a position in the range between fully opened and fully closed. Alternatively, a wood stove may have a dual regulator operated by two separate controls for primary and second air.

U.S. Pat. No. 585,677 discloses two independent air regulators. For further background, reference is made to U.S. Pat. Nos. 955,007, 2,200,248 and 2,358,044.

It is an important object of the invention to provide an improved dual air regulator for a wood stove.

It is a further object of the invention to achieve the preceding object while facilitating simultaneous locking of both regulators.

It is another object of the invention to achieve one or more of the preceding objects while obstructing sparks from exiting through the air inlets.

It is still another object of the invention to achieve one or more of the preceding objects with compactly arranged structure.

It is a further object of the invention to achieve one or more of the preceding objects with apparatus that is relatively easy and inexpensive to fabricate and relatively easy to adjust and lock by unskilled personnel.

SUMMARY OF THE INVENTION

According to the invention, there are primary and secondary regulating doors rotatable about a common axis for regulating primary and secondary air flow, respectively, and locking means embracing the common axis for preventing said first and secondary regulating doors from rotation when the locking means is selectively tightened. According to another feature of the invention baffle means on the furnace door inside coacts with the regulating doors to define air channels while obstructing sparks from exiting through air inlets.

Numerous other features, objects and advantages of the invention will become apparent from the following specification when read in connection with the accompanying drawing in which:

DETAILED DESCRIPTION OF PREFERRED EMBODIMENTS

Figure 1:
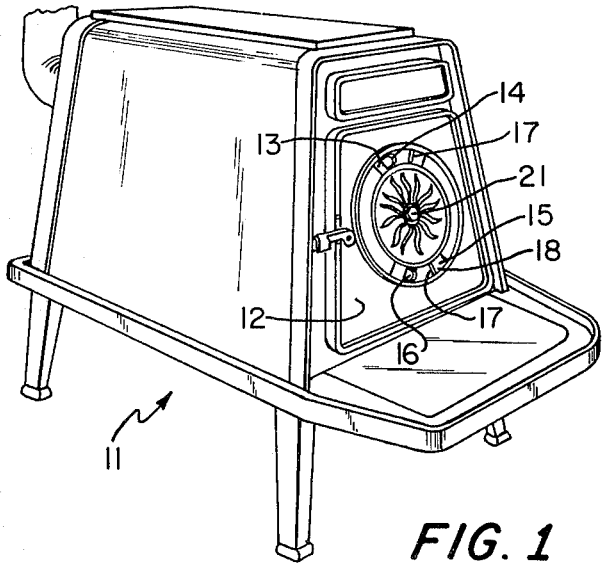
FIG. 1 is a perspective view of a wood stove having the primary and secondary controls according to the invention.

With reference now to the drawing and more particularly FIG. 1 thereof, there is shown a perspective view of a wood stove having primary and secondary air regulators in the door according to the invention. The stove 11 includes a door 12 hinged at the right having a secondary air regulating door 13 at the top adjusted by handle 14 and a primary air regulating door 15 at the bottom adjusted by handle 16. Doors 13 and 15 may ride over ribs such as 17 extending forwardly from a baffle plate 18. A locking knob 21 embracing the axis about which regulating doors 13 and 16 rotate may be rotated clockwise after regulating doors 13 and 15 are adjusted to obtain preferred air flow and rotated counterclockwise to unlock regulating doors 13 and 15 and allow them to be readjusted to change air flow as desired.

Figure 2:
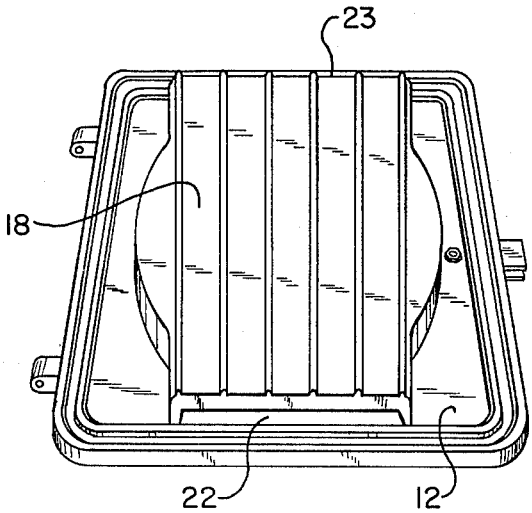
FIG. 2 is a view of the inside of the door with the baffle plate in place.

Referring to FIG. 2, there is shown the inside of door 12 with baffle plate 18 in place to define a lower air outlet 22 and an upper air outlet 23 for guiding air into the combustion chamber while obstructing sparks from exiting through the air inlets into the room.

Figure 3:
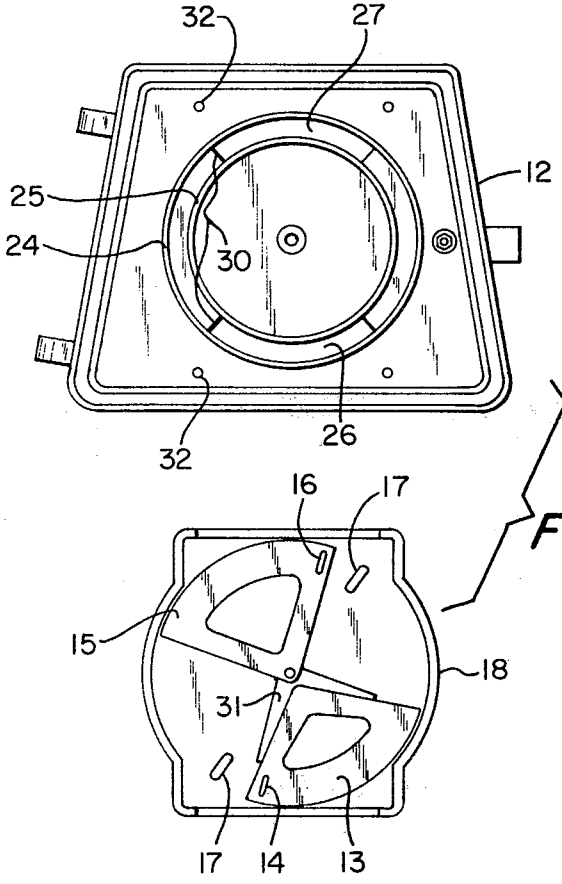
FIG. 3 is a view of the inside of the door with the baffle plate removed to expose the position of the primary and secondary air regulators.

Referring to FIG. 3, there is shown a view of the inside of door 12 with baffle plate 18 removed accommodating secondary and primary air regulating doors 13 and 15. The inside of door 12 is formed with outside and inside air sealing rings 24 and 25 embracing primary and secondary air openings 26 and 27, respectively, that are selectively covered by primary and secondary air regulating doors 15 and 13, respectively. Radial segments, such as 30, between sealing rings 24 and 25 and adjacent to the air inlets help seal the region adjacent the inlets. Secondary air regulating door 13 is formed with a step 31 for riding under regulating door 15 so that the peripheral portions of these doors are substantially in the same plane while each may be rotated independently of the other about their common axis. Locking knob 21 is at the head of a hex machine bolt seated in a tapped opening 20 that is closed on the combustion-chamber side of baffle plate 18. Tightening this bolt clamps regulating doors 13 and 15 to the inside of door 12 to maintain their selected position. Locating pins 31 seat in the corners of baffle 18 to help position baffle 18.

Figure 4:
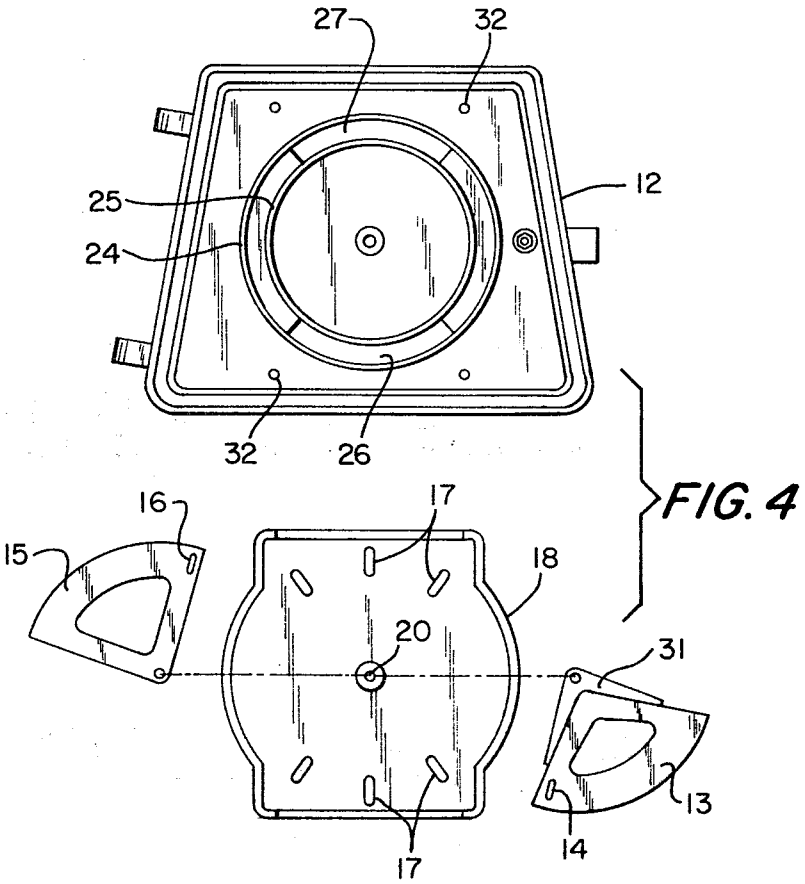
FIG. 4 is a view of the inside of the door with all parts removed.

Referring to FIG. 4, there is shown a view of the assembly of FIG. 3 with the air regulating doors 13 and 15 removed from baffle plate 18. Regulating doors 13 and 15 typically embrace a quadrant and are preferably formed with the openings as shown to reduce material and allow some flexing while having sufficient radial width at their periphery to cover the respective air inlet openings.

Having described the structural arrangement of the invention, its mode of adjustment will be discussed. Adjusting the air flow regulator helps provide proper combustion. The particular adjustment of the doors depends upon the draft of the particular chimney to which the stove then exhausts. Start by setting the secondary air regulator at about ½ to ¼ the opening of the primary regulator (except for start-ups). Then make gradual adjustments until the optimum setting for the specific situation. Turn the regulator knob counterclockwise to loosen the regulators for adjustment. This knob should be kept tightened sufficiently to allow some resistance when the regulators are moved to prevent their slipping. Use removable knob to adjust regulators when warm. Set the bottom regulator first, and then adjust the top one. Once this tension has been set, there should be no need to adjust it more than once or twice a season. For overnight build a briskly burning fire to create about one to two inches of hot coals in the bottom. Then fill the stove, close the door. Adjust the secondary air full closed. Adjust the primary air to between 0 and 10% open. These adjustments may be varied for a particular installation.

The invention has a number of advantages. It facilitates good control of air flow to optimize combustion. The structure is of a form that may be conveniently manufactured by casting, easily assembled and operated in a compact package associated with the door. Once the desired positions of the air regulating doors have been determined, they may be conveniently locked with one locking control. The structure provides an advantageous flow of air that enhances combustion efficiency while reducing ash and allowing controlled combustion for maintaining ignition over an extended period without refueling and helps keep sparks from exiting through the air inlets.

It is evident that those skilled in the art may now make numerous uses and modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In a wood stove door air flow regulating apparatus comprising, primary and secondary air regulating door means for selectively controlling the flow of air through said door, and baffle means secured to the inside of said door for coacting therewith to define an air channel while obstructing sparks in the stove combination chamber from exiting through an air inlet in said door selectively covered by said door means, said door means comprising sectoral plates corresponding substantially to a sector of a circle with each of said plates formed with an opening for accommodating an element about which a plate pivots and a significantly larger opening radially outward therefrom, at least one of said plates being formed with a stepped portion so that said plates may be mounted in partial overlapping relationship with the radially outwardmost portions thereof being in a common plane, said plates being mounted in said baffle means and said baffle means being formed with angularly spaced radial protrusions for supporting said radially outwardmost portions of said plates.

2. Wood stove air flow regulating means in accordance with claim 1 wherein said door means are pivotally mounted in said baffle means.

3. Wood stove air flow regulating apparatus in accordance with claim 1 wherein said primary and secondary air regulating door means are rotatably supported for pivotal movement about a common axis.

4. Wood stove air flow regulating apparatus in accordance with claim 3 and further comprising, locking means secured to said door and embracing said common axis for selectively locking said primary and secondary door means in selected positions.

5. Wood stove air flow regulating apparatus in accordance with claim 1 wherein said plates correspond substantially to a quadrant of a circle.

6. Wood stove air flow regulating apparatus in accordance with claim 1 wherein said plates are formed with handle portions and said door is formed with arcuate openings for accommodating said handle portions.

7. Wood stove air flow regulating apparatus in accordance with claim 6 and further comprising, locking means embracing said common axis responsive to rotation thereof for selectively locking said plates in previously selected positions.

* * * * *